United States Patent [19]

Okumura et al.

[11] Patent Number: 4,479,607

[45] Date of Patent: Oct. 30, 1984

[54] RAIL FASTENING DEVICE

[75] Inventors: Shuichi Okumura, Kamakura; Yutaka Satoh, Tama, both of Japan

[73] Assignee: Toyo Kizai Kabushiki Kaisha, Tokyo, Japan

[21] Appl. No.: 396,527

[22] Filed: Jul. 8, 1982

[30] Foreign Application Priority Data

Apr. 21, 1982 [JP] Japan ..... 57-56959[U]

[51] Int. Cl.[3] ..... E01B 9/48

[52] U.S. Cl. ..... 238/349; 238/338; 238/304

[58] Field of Search ..... 238/310, 315, 349, 338, 238/351, 304

[56] References Cited

U.S. PATENT DOCUMENTS

| | | | |
|---|---|---|---|
| 1,067,125 | 7/1913 | Maney | 238/349 |
| 2,446,857 | 8/1948 | Snyder | 238/349 |
| 3,366,335 | 1/1968 | Baker | 238/349 |
| 3,451,621 | 6/1969 | De Splinter | 238/315 |
| 3,982,692 | 9/1976 | Feyrer et al. | 238/349 |
| 4,150,792 | 4/1979 | Qureshi | 238/349 |
| 4,179,067 | 12/1979 | Baier | 238/349 X |
| 4,424,935 | 1/1984 | Langman et al. | 238/349 |

*Primary Examiner*—Randolph Reese
*Assistant Examiner*—Glenn Foster
*Attorney, Agent, or Firm*—Flynn, Thiel, Boutell & Tanis

[57] ABSTRACT

Disclosed is a rail fastening device adapted to fasten a rail. The device includes leaf springs each being bent at its intermediate portion and provided at its base portion with a screw spike hole and at the rail pressing end thereof with an elongated hole. A tie plate is laid between a rail and a sleeper. The tie plate has a central rail mounting surface and screw spike holes formed at both sides of the rail mounting surface. The screw spike holes formed in the base of the leaf spring and in the tie plate at each side of the rail are adapted to receive a screw spike having a flange having a diameter smaller than the width of the elongated slot. The device further has a fastening member on the peripheral surface of the screw spike and adapted to press, when the screw spike is driven into the sleeper through the screw spike holes into the sleeper, the periphery of the screw spike hole in the base end of the leaf spring onto the periphery of the screw spike hole in the tie plate, while leaving a gap between the flange and the leaf spring.

5 Claims, 9 Drawing Figures

RAIL FASTENING DEVICE

BACKGROUND OF THE INVENTION

The present invention relates to a rail fastening device and, more particularly, to a rail fastening device suitable for use in a wooden sleeper section of railroad construction for trains of a motive power having a heavy axle load and freight cars of heavy weights.

A typical conventional rail fastening device which has been used for wooden sleeper section of railroad construction will be explained hereinunder with specific reference to FIGS. 1 and 2. A tie plate 2 is fastened by dog spikes 3 on the upper surface of a sleeper 1. A rail 4 is mounted on the central portion of the tie plate 2. As will be seen from FIG. 2, the tie plate 2 is provided at its both sides with notches 5 to which bolts 6 are fastened at their lower ends. The notches 5 receive also the base ends 8 of leaf springs 7. The leaf spring 7 is bent at about 180° at its intermediate bent portion 9, and a bolt hole 11 is formed in the portion of the leaf spring 7 between the end 10 and the bent portion 9. For inserting the base end 8 of the leaf spring 7 into the notch 5 of the tie plate 2, the bolt 6 is inserted into the bolt hole 11 and a nut 12 is screwed to the bolt 6 from the upper end thereof. As the nut 12 is tightened, the end 10 of the leaf spring 7 is brought into pressure contact with the rail 4 thereby to resiliently fasten the rail 4 to the tie plate 2.

This conventional rail fastening device, however, showed the following disadvantages when used in a railroad section under severe load condition.

(1) The hole 11 is formed in such a portion of the leaf spring 7 that undergoes the greatest stress, so that it is necessary to increase the thickness of the leaf spring 7 for attaining a higher safety. In consequence, the amount of material used is increased and, hence, the spring constant with respect to the end 10 is increased to make it difficult to follow up slight vibrations of the rail.

(2) The nut 12 is tightened with a force which is about 2 times as large as the force with which the end 10 of the leaf spring 7 fastens the rail 4. In consequence, the bolt 6 is deteriorated soon, namely the bolt 6 cannot have sufficient durability.

(3) The leaf spring 7 having the simple construction as shown in FIG. 2 cannot produce sufficient resistance to the turning of rail sideways which may be caused by an excessively large lateral force. It is possible to use a fastening spring having such a two-staged linear spring constant as having a large spring constant in order to bear upward load which tends to turn the rail sideways but a small spring constant for tightening fixedly the rail. Such a spring, however, has an impractically complicated construction and is difficult to fabricate. In addition, such a spring cannot sufficiently receive surface treatment required to attain sufficient durability. Thus, it takes much money for putting such a spring into practical use.

(4) The lateral force generated during running of the train is finally received by the dog spikes 3. However, when the lateral force is extremely large, the durability of the dog spike 3 is deteriorated and, at the same time, the sleeper 1 is damaged soon. In addition, frequent railroad maintenance work is required for preventing the dog spikes 3 from becoming loose.

It is advantageous that the rail fastening spring has a large thickness for producing a large resistance to the force which acts to turn the rail sideways. On the other hand, in order that the spring can exert its characteristics to follow up fine vibrations of the rail, it is necessary that the end of the leaf spring has as small a spring constant as possible.

SUMMARY OF THE INVENTION

Accordingly, an object of the invention is to provide a rail fastening device which can meet the above-described demand while overcoming the problems (1) to (4) of the prior art mentioned before.

To this end, according to the invention, there is provided a rail fastening device comprising: leaf springs each being bent at its intermediate portion and having a screw spike hole at its base end and an elongated slot at its end which is adapted to press against the rail; a tie plate laid between a sleeper and the rail and provided with screw spike holes formed in both sides of the rail mounting surface thereof; screw spikes each having a flange of a diameter greater than the width of the elongated slot, the screw spike being loosely received by the associated elongated slot and screwed into the sleeper through the screw spike holes formed in the base portion of the leaf spring and in the tie plate; and fastening members each being located around a corresponding screw spike, the fastening member being adapted to press, when the screw spike is screwed into the sleeper, the periphery of the screw spike hole in the base end of the leaf spring to the periphery of the screw spike hole in the tie plate while preserving a gap between the flange formed at upper portion of the screw spike and the leaf spring.

The above and other objects, features and advantages of the invention will become clear from the following description of the preferred embodiment of the invention taken in conjunction with the accompanying drawings.

DESCRIPTION OF THE PREFERRED EMBODIMENTS

Figure 1:
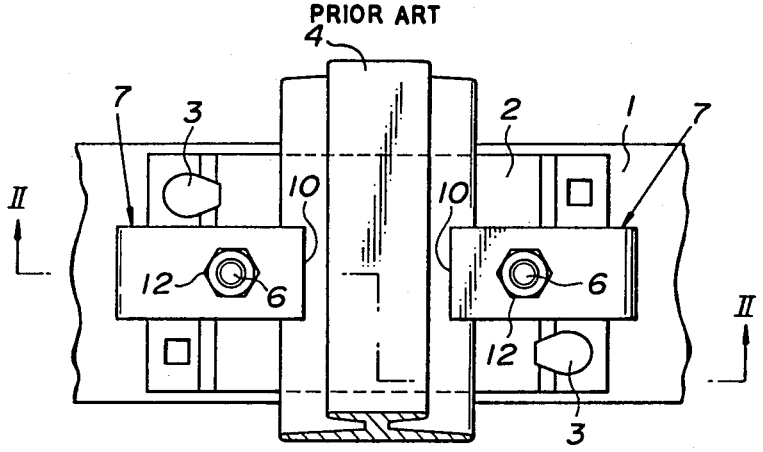
FIG. 1 PRIOR ART
FIG. 1 is a plan view of a conventional rail fastening device.
Figure 2:
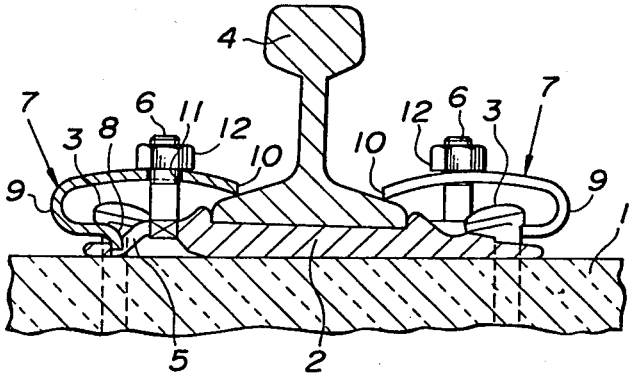
FIG. 2 PRIOR ART
FIG. 2 is a vertical sectional view of the device taken along the line II—II of FIG. 1.
Figure 3:
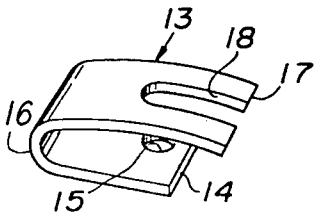
FIG. 3 is a perspective view of an example of a leaf spring incorporated in a rail fastening device in accordance with an embodiment of the invention.
Figure 4:
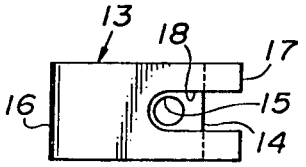
FIG. 4 is a plan view of the leaf spring shown in FIG. 3.
Figure 5:
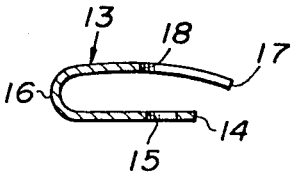
FIG. 5 is a vertical sectional view of the leaf spring shown in FIG. 4.

Referring first to FIGS. 3 through 5, there is shown a leaf spring 13 incorporated in a rail fastening device of the invention. The leaf spring 13 is provided at its base end 14 with a screw spike hole 15 and is bent at about 180° at a mid portion 16 thereof. In addition, an end 17 is provided with an elongated slot 18 cut in the end 17 of the leaf spring 13 so as to extend in the longitudinal direction of the leaf spring 13. As will be understood from FIG. 4, the elongated slot 18 has a width which is greater than the diameter of the screw spike hole 15.

Figure 6:
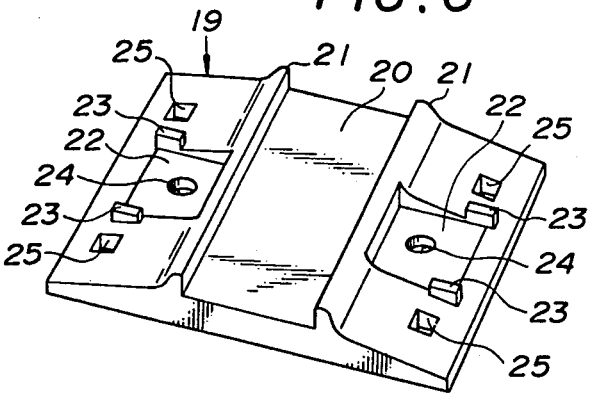
FIG. 6 is a perspective view of a tie plate incorporated in a rail fastening device of the invention.

Referring to FIG. 6, a reference numeral 19 denotes a tie plate 19 having a central rail mounting surface 20 at both sides of which are formed protrusions 21. Spring seat surfaces 22 having flat form are formed on both side portions of the tie plate 19 at both sides of the protrusions 21 to provide seats for the base ends 14 of the leaf spring 13. Projections 23 for preventing the rotation of the leaf spring 13 are formed at the front and rear sides of the spring seat surface 22 (upper and lower sides as viewed in FIG. 6). A screw spike hole 24 is formed substantially at the center of each spring seat surface 22. The arrangement is such that, when the base end 14 of the leaf spring 13 is placed at the correct position on the spring seat surface 22, the spring spike hole 24 in the tie plate 19 is vertically aligned with the spring spike hole 15 in the leaf spring 13. Spike holes 25 are formed in four corners of the tie plate 19.

Figure 7:
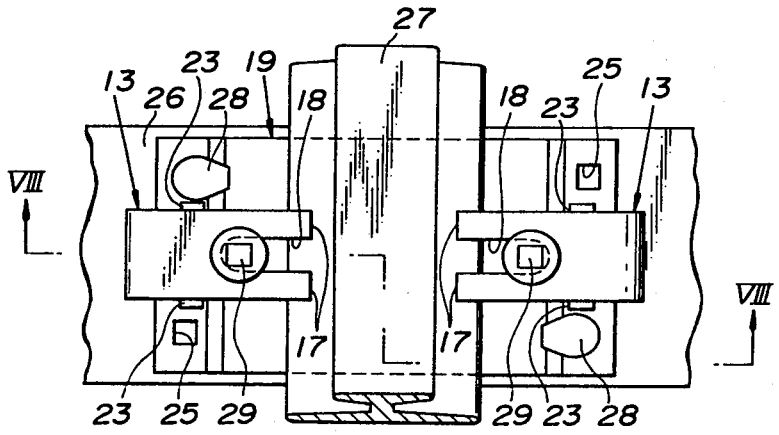
FIG. 7 is a plan view of a rail fastening device in accordance with an embodiment of the invention.

A rail is fastened to a sleeper with the above-described leaf spring 13 and the tie plate 19 in a manner explained hereinunder. Namely, referring to FIGS. 7 and 8, at first the tie plate 19 is placed at the right place on the sleeper 26, and then rails 27 are mounted on the rail mounting surface 20 of the tie plate 19. Then, while preserving a predetermined gauge (distance) between two rails 27, ends of the spikes 28 are inserted into the spike holes 25 of the tie plate 19 and are hit and driven into the sleeper 26 thereby to fix the tie plate 19 to the sleeper 26. Usually, two spikes 28 are inserted into the two spike holes 25 arranged on a diagonal line as shown in FIG. 7 for fixing the tie plate 19 to the sleeper 26.

Figure 8:
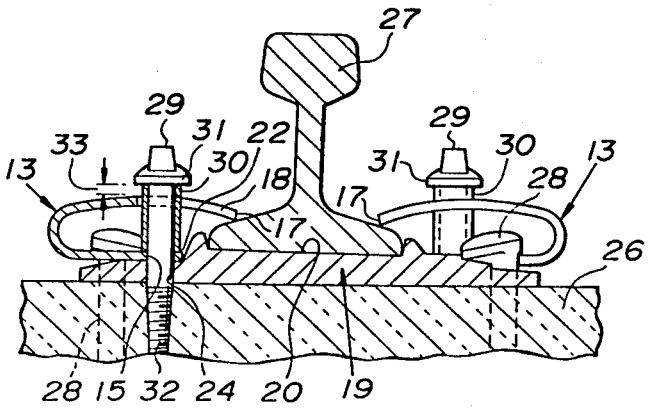
FIG. 8 is a sectional view taken along the line VIII—VIII of FIG. 7.

Subsequently, leaf springs 13 are placed at both sides of the rail 27 such that the base ends 14 of the leaf springs 13 rest on the spring seat surfaces 22 on the tie plate 19. A cylindrical collar 30 as shown in FIG. 8 is fitted around the screw spike 29 as shown in FIG. 8. As is well known, the screw spike 29 has a polygonal head portion so as to be rotated by a wrench or the like. A flange 31 is formed to continue from the polygonal head and the stem portion extending downwardly from the flange 31 is provided with a threaded stem 32. In the screw spike 29 used in this invention, the flange 31 has a diameter greater than the width of the elongated slot 18 formed in the end portion of each leaf spring 13. As will be explained later, the collar 30 fitted around the screw spike 29 functions as a fastening member for fastening the leaf spring 13. The collar 30 has an inside diameter just for fitting around the stem portion of the screw spike 29. The outside diameter of the collar 30 is greater than the diameter of the screw spike hole 15 formed in the leaf spring 13 but is smaller than the width of the longated slot 18. Therefore, the collar 30 cannot be received by the screw spike hole 15 but can be received by the elongated hole 18 without substantial difficulty. As shown in FIG. 8, the collar 30 has such a length that, when the lower end of the collar 30 rests around the screw spike hole 15 of the leaf spring 13, the upper end of the collar 30 projects above the elongated hole 18.

As the collar 30 is fitted around the screw spike 29 and the latter is inserted into the elongated hole 18 and the screw spike holes 15 and 24 from the upper side in that order, the lower end of the collar 30 contacts the periphery of the screw spike hole 15 in the leaf spring 13, so that the upper end of the collar 30 projects upward through the elongated slot 18. As the screw spike 29 is rotated in this state by a wrench, the screw spike 29 passes through the screw spike hole 24 of the tie plate 19 and its threaded stem 32 is screwed into the wooden sleeper 26.

The collar 30 cannot fit in the screw spike hole 15 in the leaf spring 13 even though, as indicated in FIG. 8, the screw spike 29 is displaced downwardly as the threaded stem 32 is driven into the sleeper 26. Therefore, the downward displacement of the collar 30 is stopped by the periphery of the screw spike hole 15 in the leaf spring 13 and the upper end of the collar 30 is pressed by the lower surface of the flange 31. In this state, it is not possible to drive the screw spike 29 into the sleeper 26 by rotating the same any more. The rotation and displacement of the leaf spring 13 is prevented by the projection 23 during driving of the screw spike 29 into the sleeper 26. As the upper end of the collar 30 is pressed by the flange 31 of the screw spike 29, the lower end of the collar 30 presses the portion of the leaf spring 13 around the screw thread hole 15, so that the base end portion 14 of the leaf spring 13 is pressed at a constant pressure onto the spring seat surface 22 on the tie plate 19 thereby to fasten the base end 14 of the leaf spring 13 onto the tie plate 19. In this state, the lower surface of the flange 31 contacts only the upper end of the collar 30, while a gap 33 is left between the lower surface of the flange 31 and the leaf spring 13, and the end 17 of the leaf spring 13 is pressed against the bottom portion of the rail 27 by the resilience of the leaf spring 13 itself, and, thereby, to fasten the rail 27 onto the rail mounting surface 20 of the tie plate 19 at a constant pressure.

In the event that a large lateral force is applied to the rail 27 fastened by the leaf springs 13 onto the tie plate 19 to act to turn the rail 27 sideways, an upward force is applied to the end 17 of one of the leaf springs 13 by the bottom of the rail 27. However, as the leaf spring 13 is moved upward by a distance corresponding to the gap 33, the leaf spring 13 comes into contact with the lower surface of the flange 31 so that further upward deformation of the leaf spring 13 is prevented. Therefore, as the rail 27 is declined slightly in the lateral direction, an extremely large resistance is produced to resist to the force which is acting to turn the rail 27 sideways and prevent the turning of rail 27.

Figure 9:
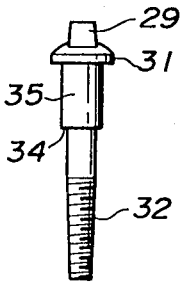
FIG. 9 is a front elevational view of another example of a screw spike.

FIG. 9 shows another example of the screw spike 29. This screw spike 29 has a stepped portion 34 above the threaded stem 32 and an enlarged portion 35 between the stepped portion 34 and the lower surface of the flange 31. This screw spike 29, therefore, is a combination of the collar 30 shown in FIG. 8 and the screw spike 29. Although the outside diameter of the enlarged portion 35 is greater than the diameter of the screw spike hole 15 in the leaf spring 13, it is smaller than the width of the elongated slot 18. In use, each screw spike 29 is inserted into the elongated slot 18 and spike screw holes 25, 24 and then rotated by a wrench so as to be driven into the sleeper 26. As the screw spike 29 is driven deeper into the sleeper 26, the stepped portion 34 comes to press the leaf spring 13 around the screw spike hole 15 at a constant force. In this state, it is not possible to drive the spike screw 29 into the sleeper 26 any more. In this state, the enlarged portion 35 serves as the fastening member for the leaf spring 13.

In the conventional rail fastening device, it has been necessary to carefully observe the rotation angle of the nut 12 or to use a torque wrench for rotating the nut 12, in order to obtain a constant fastening force. In contrast to the above, according to the invention, it is possible to fasten the base end 14 of the leaf spring 13 at a constant pressure to the tie plate by rotating the screw spike 29 until it becomes unrotatable. In this state, since the leaf spring 13 is not restrained at any other portion thereof than the base portion 14, the end 17 of the leaf spring 13 presses the rail 27 with the force which coincides with the design force, thereby to resiliently fasten the rail 27 onto the tie plate 29. Furthermore, since the end 17 of the leaf spring 13 is provided with an elongated slot 18, the spring constant of the end 17 of the leaf spring 13 is small enough to permit the end 17 to follow up slight vibrations of the rail 27.

Furthermore, in the tie plate 19 of the invention, it is not necessary to provide the notches 5 of complicated shape for fixing the lower ends of the bolts 6, which are essential in the conventional rail fastening device. Namely, according to the invention, it suffices only to provide the tie plate 19 with the spike holes 25, so that the cost of production of the tie plate is remarkably decreased. If spike screws are used in place of the dog spikes to fix the tie plate 19 onto the sleeper 26, round screw spike holes are formed in place of the square dog spike holes 25.

It is to be noted also that, according to the invention, the resistance to the lateral force applied to the rail 27 is shared by the screw spikes 29 and the dog spikes 28. This means that the dog spikes 28 are relieved from the burden of resistance to the lateral force applied to the rail 28. This in turn permits the use of less expensive wooden sleepers in place of expensive concrete sleepers, even in the railroad section under severe load condition.

What is claimed is:

1. In a rail fastening device for securing a railway rail having a base flange to a railway sleeper, the improvement which comprises: said fastening device comprises a tie plate laid between said sleeper and said base flange of said rail, said tie plate having an upper surface and having laterally spaced-apart screw spike holes disposed on opposite lateral sides of said base flange of said rail;

a leaf spring associated with each of said screw spike holes, said leaf spring being reversely bent between its ends to form a lower leg and an upper leg which are opposed to and are vertically spaced from each other, said lower leg of said leaf spring bearing on said upper surface of said tie plate and having an aperture therethrough which aperture is in registry with its associated screw spike hole in said tie plate, said upper leg of said leaf spring having a free end which engages said base flange of said rail and resiliently presses said rail against said tie plate, said upper leg having an elongated slot extending lengthwise from said free end thereof to a location above said screw spike hole and said aperture;

a screw spike associated with each of said leaf springs and said screw spike holes, each said screw spike having a stem extending downwardly through its associated slot, aperture and screw spike hole, said stem having a threaded lower portion extending into said sleeper and threadedly engaged therewith, said screw spike having a flange adjacent to its upper end which flange is vertically upwardly spaced from the upper surface of said upper leg of said leaf spring, said flange being wider than said slot so that said flange cannot be moved through said slot, the portion of said stem that extends through said slot being of lesser width than said slot; and a spacer on said stem of said screw spike, said spacer extending downwardly from said flange of said screw spike through said slot in said upper leg of said leaf spring, the portion of said spacer that extends through said slot being of lesser width than said slot so that said upper leg of said leaf spring can move upwardly and downwardly with respect to said spacer and said stem, the lower end of said spacer bearing against the upper surface of said lower leg of said leaf spring adjacent to said aperture and pressing said lower leg of said leaf spring against said tie plate, the length of said spacer being such that the upper end of said spacer projects above the upper side of said elongated slot whereby said flange on said screw spike is spaced upwardly from and does not bear against the upper surface of said upper leg of said leaf spring and the entirety of said upper leg of said leaf spring is free to flex upwardly and downwardly relative to said screw spike.

2. A rail fastening device according to claim 1 in which said spacer is a collar sleeved on said screw spike.

3. A rail fastening device according to claim 1 in which said spacer is an enlarged portion integral with said screw spike.

4. A rail fastening device according to claim 1 in which said leaf spring is reversely bent through an angle of about 180° so that said leaf spring is substantially U-shaped.

5. A rail fastening device as claimed in claim 4 in which said upper surface of said tie plate has a flat portion against which bears said lower leg of said leaf spring, and including projections extending upwardly from said upper surface of said tie plate on opposite sides of said flat portion thereof for engaging the edges of said lower leg of said leaf spring and preventing rotation thereof about the central axis of said screw spike hole.

* * * * *